US006622682B2

(12) United States Patent
Ikuma et al.

(10) Patent No.: US 6,622,682 B2
(45) Date of Patent: Sep. 23, 2003

(54) SEALING ARRANGEMENT FOR AN INTAKE MANIFOLD OF AN INTERNAL COMBUSTION ENGINE

(75) Inventors: Tomonori Ikuma, Wako (JP); Tetsu Wada, Wako (JP); Kazuyoshi Sato, Wako (JP); Kazuyori Kito, Kanagawa (JP); Yoshio Shibuya, Kanagawa (JP)

(73) Assignees: Honda Giken Kogyo Kabushiki Kaisha, Tokyo (JP); Mikuni Corporation, Tokyo (JP)

( * ) Notice: Subject to any disclaimer, the term of this patent is extended or adjusted under 35 U.S.C. 154(b) by 0 days.

(21) Appl. No.: 10/146,570

(22) Filed: May 14, 2002

(65) Prior Publication Data

US 2002/0189567 A1 Dec. 19, 2002

(30) Foreign Application Priority Data

May 15, 2001 (JP) ..... 2001-144979

(51) Int. Cl.[7] ..... F02M 35/10
(52) U.S. Cl. ..... 123/184.34; 123/184.47
(58) Field of Search ..... 123/184.34, 184.47, 123/184.24, 184.42

(56) References Cited

U.S. PATENT DOCUMENTS 3,018,767 A * 1/1962 Sailler ..... 123/184.34
3,783,845 A * 1/1974 Brandstetter ..... 123/184.34
4,440,120 A * 4/1984 Butler ..... 123/184.34
4,784,091 A * 11/1988 Okada et al. ..... 123/184.34
5,400,750 A * 3/1995 Jaeger et al. ..... 123/184.47
5,544,629 A * 8/1996 Ohata et al. ..... 123/184.36
5,839,404 A * 11/1998 Numata et al. ..... 123/184.34
6,192,849 B1 * 2/2001 Powell ..... 123/184.34

FOREIGN PATENT DOCUMENTS

JP 8-14126 1/1996

* cited by examiner

*Primary Examiner*—Marguerite McMahon
(74) *Attorney, Agent, or Firm*—MacPherson Kwok Chen & Heid LLP

(57) ABSTRACT

In an intake manifold of an internal combustion chamber comprising a surge tank assembly and intake pipe assembly, a seal member is interposed between the end surface of the intake pipe assembly and the mating surface of the surge tank assembly so as to seal off the intake passage and mounting holes individually. Thus, the seal member, combined with the use of the blind threaded holes for the threaded bolts joining the two parts, ensures the sealing of both the intake passages and mounting holes at the interface between the end surface of the intake pipe and the mating surface of the surge tank assembly in a both reliable and simple manner. Preferably, the seal member comprises an O-ring made of elastomeric material, and at least one of the mating surface and end surface is provided with a groove for receiving the seal member.

15 Claims, 4 Drawing Sheets

SEALING ARRANGEMENT FOR AN INTAKE MANIFOLD OF AN INTERNAL COMBUSTION ENGINE

TECHNICAL FIELD

The present invention relates to an intake manifold of an internal combustion engine, and in particular to a sealing arrangement for an intake manifold of an internal combustion engine.

BACKGROUND OF THE INVENTION

A V-type engine comprises a pair of cylinder banks, and the intake ports are typically provided on the sides of the cylinder banks facing each other. Therefore, an intake manifold is typically provided between the two cylinder banks, and communicate with the intake ports via intake passages extending toward or away from the crankshaft of the engine. Sometimes, the intake manifold is provided with intake passages having a prescribed length for effecting an inertia supercharging and a surge tank having a prescribed volume for effecting a resonance supercharging (See Japanese patent laid open publication No. 8-14126).

According to the invention disclosed in this Japanese paten publication, the intake passages are defined by first intake pipes extending from the intake ports and second intake pipes extending between the upstream end of the first intake pipes and a surge tank. The first intake pipes are joined to each other by flanges at both ends so as to form an integral unit for each cylinder bank. The second intake pipes are integrally formed with the surge tank. Therefore, in this case, the intake manifold essentially consists of three major pieces. The first intake pipes are joined to the second intake pipes by threaded bolts which are passed through the radial flanges provided on the opposing ends thereof. According to this conventional arrangement, the surge tank is configured so as not to interfere with the fastening of these threaded bolts.

In recent years, there is a growing demand to minimize the size of the engine while maximizing the performance of the engine. For instance, the engines for outboard marine drives are required to be contained in a limited space of a cowling. In such a case, the size of the surge tank is often desired to be increased for an optimum resonance effect to such an extent that the surge tank may interfere with the fastening of the threaded bolts for joining the two parts of the intake manifold.

To avoid this problem, it is conceivable to increase the size of the flange, but it leads to the problems associated with sealing, and availability of space around the engine. Alternatively, the threaded bolts may be allowed to be passed across the mounting surfaces of the two parts from the interior of the surge tank. However, it will require not only to provide a removable cover to the top wall of the surge tank to permit access to the threaded bolts but also to provide a sealing arrangement in an interface between the two parts of the intake manifold for preventing leakage of air or negative pressure via the mounting holes for receiving the threaded bolts. Also, the threaded holes receiving the threaded bolts would cause leakage of air or negative pressure along a spiral path if they are formed as through holes.

When the intake manifold is formed by injection molded or otherwise prepared plastic material, it is often necessary to form the intake manifold out of a plurality of pieces. In such a case, it is necessary to design the intake manifold so as to permit access for the tools that are required for assembling and removing the intake manifold. This requirement places a severe restriction on the freedom in designing the intake manifold.

BRIEF SUMMARY OF THE INVENTION

In view of such problems of the prior art, a primary object of the present invention is to provide an intake manifold of an internal combustion engine which is suited to be molded from plastic material.

A second object of the present invention is to provide an intake manifold of an internal combustion engine which is simple and economical.

A third object of the present invention is to provide an intake manifold of an internal combustion engine which allows the intake manifold incorporated with a surge tank to be assembled to the engine without being interfered by the surge tank.

A fourth object of the present invention is to provide an intake manifold of an internal combustion engine which allows a surge tank having a relatively large volume to be achieved without detracting from the compact design of the engine.

According to the present invention, these and other objects can be accomplished by providing an intake manifold for an internal combustion engine, comprising: an intake pipe assembly including at least one intake pipe defining an intake passage having a downstream end attached to an intake port of the engine and an upstream end defining an end surface, the end surface being provided with a plurality of threaded blind holes; a surge tank assembly including a bottom wall, peripheral wall and upper wall jointly defining a chamber having a certain volume therein, the chamber including a downstream end abutting the end surface at the upstream end of the intake pipe and an upstream end connected to a throttle body for introducing intake air into the chamber in a controlled manner, the bottom wall being provided with a mating surface adapted to the end surface and mounting through holes corresponding to the threaded blind holes; threaded bolts passed through the mounting through holes from inside the chamber and threaded into the threaded blind holes to securely connect the downstream end of the chamber with the upstream end of the intake pipe; and a seal member interposed between the end surface of the intake pipe and the mating surface of the surge tank assembly so as to seal off the intake passage and mounting holes individually.

Thus, the seal member, combined with the use of the blind threaded holes, ensures the sealing of both the intake passages and mounting holes at the interface between the end surface of the intake pipe and the mating surface of the surge tank assembly in a both reliable and simple manner. Preferably, the seal member comprises an O-ring made of elastomeric material, and at least one of the mating surface and end surface is provided with a groove for receiving the seal member. The O-ring provides a favorable sealing even when the contact pressure between the two surfaces is not significant so that the various components of the intake manifold can be made of plastic or other relatively soft or deformable material without creating any problem. The seal member may also comprise a gasket that individually seals off the intake passages and mounting holes.

If the engine comprises a plurality of cylinders, the seal member may comprise a main part surrounding each intake passage, a connecting part connecting adjacent main parts, and a peripheral part extending along periphery of an interface between the end surface and mating surface and joining the main parts of the seal member, the threaded bolts being passed through between the main parts and peripheral part of the seal member.

A spacer member may be interposed between the mating surface and end surface, the spacer member being provided with through holes corresponding to the intake passage and mounting through holes. This increases the choice of the materials for the various parts of the intake manifold, and simplifies the fabrication of the various parts. The groove for receiving the sealing member may be formed on a side of the spacer member.

According to a preferred embodiment of the present invention, at least most part of the surge tank assembly is made of plastic material to reduced the weight of the intake manifold. If necessary, at least most part of the intake pipe assembly is made of metallic member so that the overall mechanical strength may be ensured.

The top wall of the surge tank assembly is preferably provided with an opening for permitting access to a head of each of the threaded bolts, and a lid member for detachably closing the opening. In such a case, the lid member may be provided with a relatively high rigidity so that the overall rigidity of the surge tank may be ensured without increasing the overall weight. When the bottom wall of the surge tank assembly is made of plastic material, the mounting through hole may be defined by a metallic collar securely fitted into the bottom wall. This provides an adequate resistance or mechanical strength against the axial forces of the threaded bolts.

The surge tank assembly may comprise an intake pipe extension formed in the downstream end of the chamber, the intake pipe extension being provided with a downstream end communicating with the upstream end of the intake pipe, and an upstream end opening out inside the chamber. The intake pipe extension, in cooperation with the intake pipe, provides a relatively large length for the intake passage so as to achieve a desired inertia supercharging effect.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
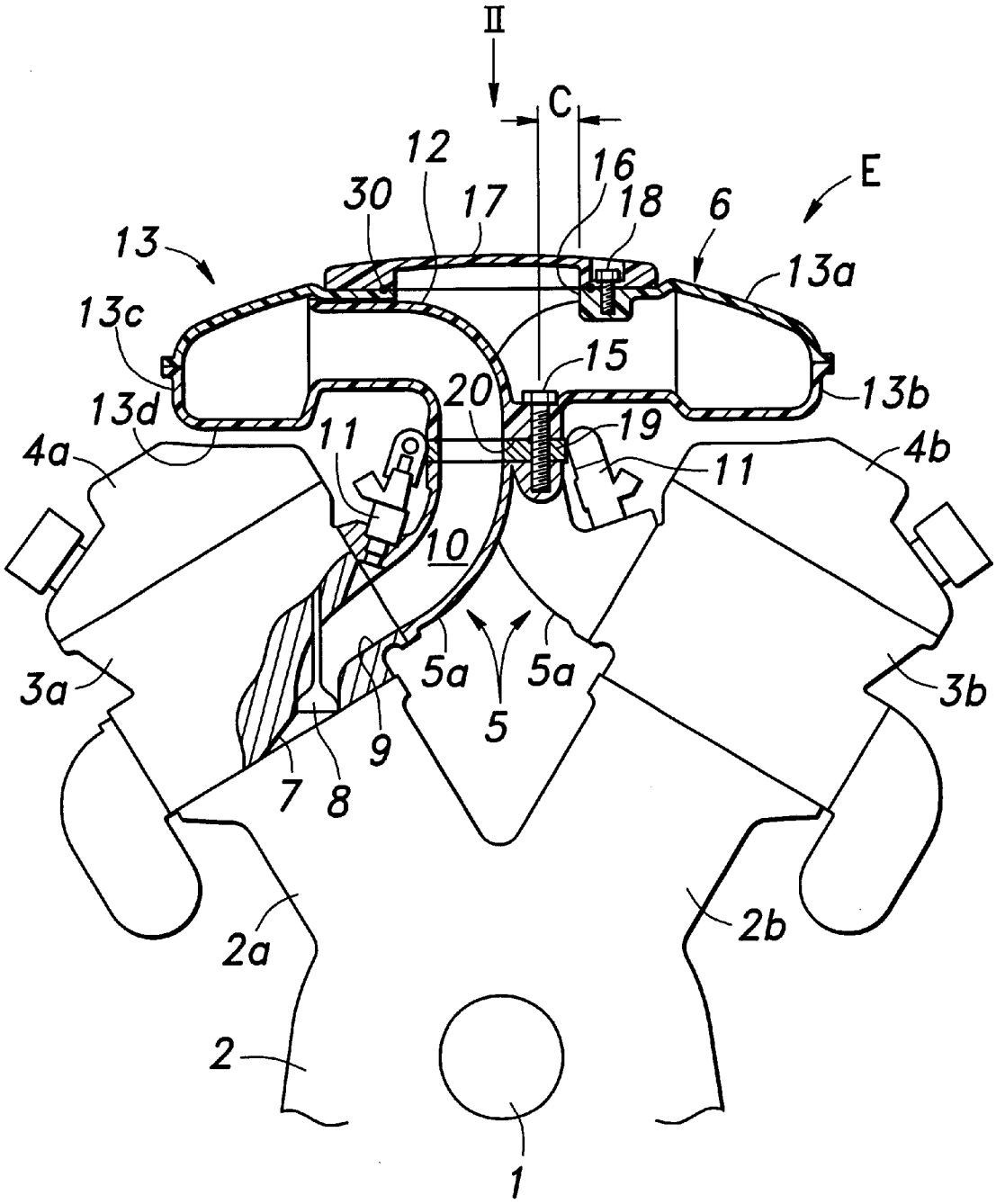
FIG. 1 is a partly broken away schematic front view of an internal combustion engine embodying the present invention.
Figure 2:
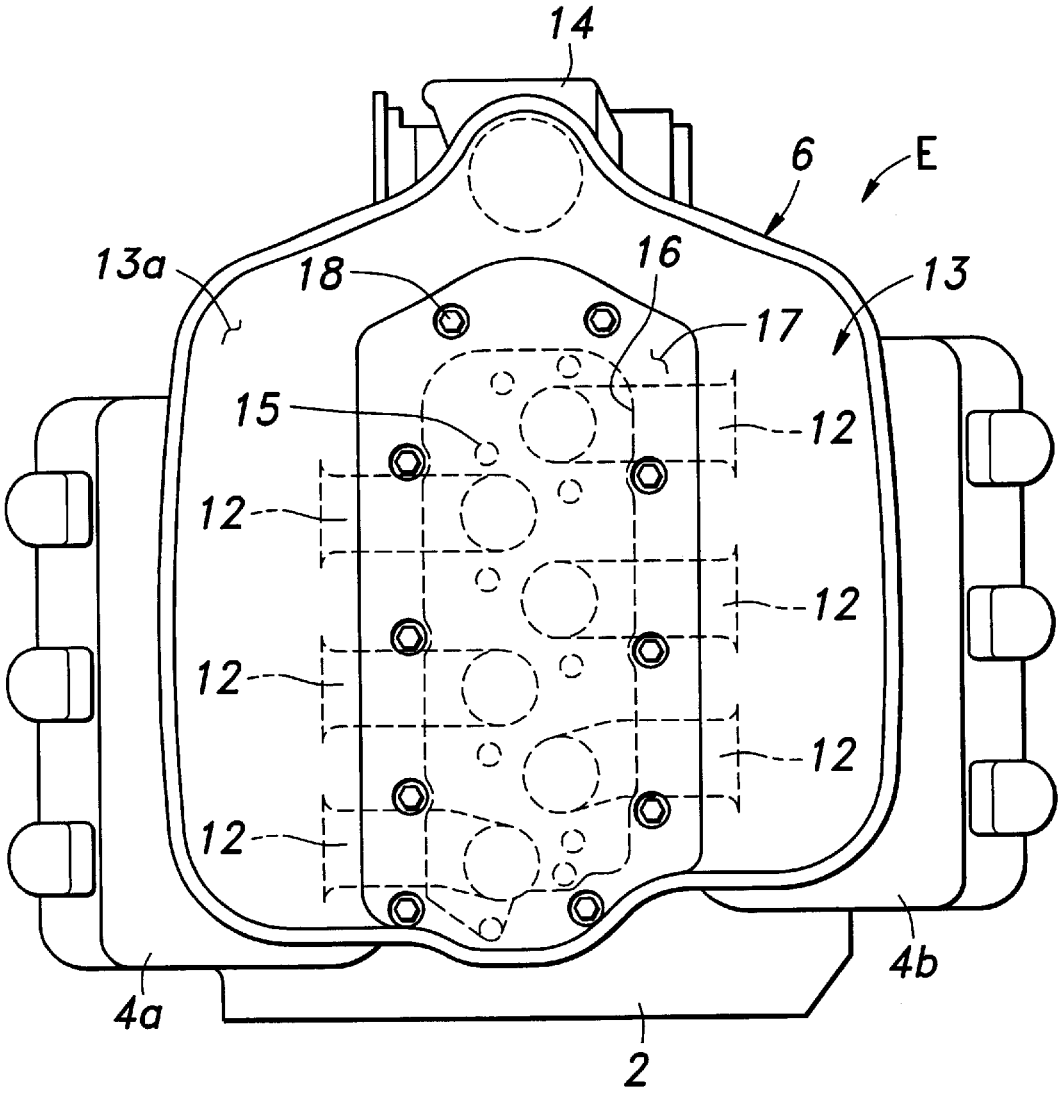
FIG. 2 is a plan view as seen from the direction indicated by arrow II in FIG. 1.
Figure 3:
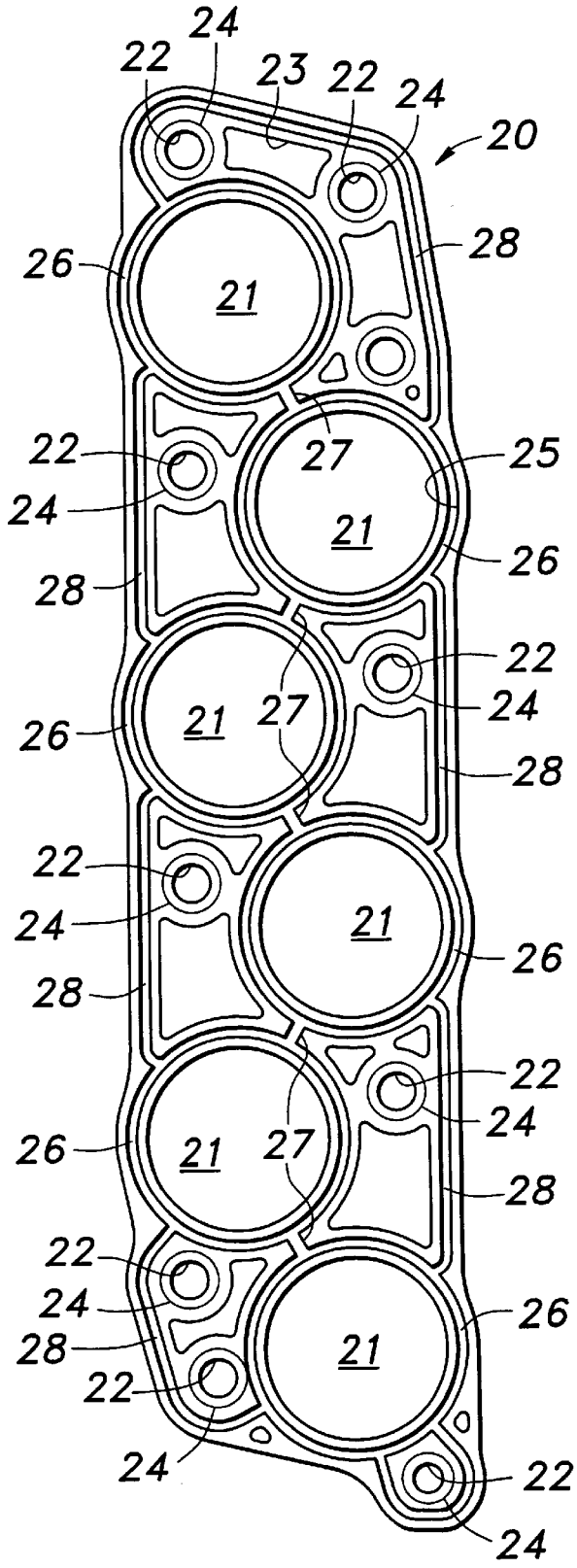
FIG. 3 is an end view of the mating surface of the surge tank assembly.

FIGS. 1 and 2 show a V-type six-cylinder internal combustion engine E embodying the present invention. The engine E comprises a cylinder block 2 including a pair of cylinder parts 2*a* and 2*b* arranged symmetrically about a crankshaft 1 in an arrangement of letter-V, a pair of cylinder heads 3*a* and 3*b* attached to the top ends of the corresponding cylinder parts 2*a* and 2*b*, and a pair of head covers 4*a* and 4*b* attached to the top ends of the corresponding cylinder heads 3*a* and 3*b*. Each cylinder head 3*a* and 3*b* defines combustion chambers in cooperation with the corresponding cylinder part 2*a* and 2*b*, and internally defines intake ports 9 which are selectively communicated with the corresponding combustion chambers by virtue of intake valves 8.

This engine is suitable for use as a vertical crankshaft engine for outboard marine drives, but may also be used for any other purposes. The engine E further comprises a pair of intake pipe assemblies 5 disposed between the two cylinder banks and each incorporating intake pipes 5*a* corresponding to the cylinders provided in each cylinder bank. Each intake pipe 5*a* is provided with a downstream end connected to the corresponding intake port 9 of the corresponding cylinder bank. A surge tank assembly 6 is commonly connected to the upstream ends of the intake pipe assemblies 5. The surge tank assembly 6 extends laterally so as to be located above a part of the head covers 4*a* and 4*b*.

Each intake pipe assembly 5 defines intake passages 10 which communicate with the corresponding intake ports 9 defined in the corresponding cylinder head 3*a* and 3*b*. The intake passages 10 defined in the intake pipe assemblies 5 extend substantially vertically away from the crankshaft 1. Fuel injection valves 11 are attached to the intake pipe assemblies 5, and are disposed in such a manner that fuel may be injected into the corresponding intake ports 9 defined in the cylinder heads 3*a* and 3*b*.

The surge tank assembly 6 consists of a hollow structure made of plastic material, and extends above and across the cylinder heads 3*a* and 3*b*. The surge tank assembly 6 comprises intake pipe extensions 12 defining extensions of the intake passages 10 defined in the intake pipe assemblies 5, and a surge tank 13 surrounding the intake pipe extensions 12. Thus, the intake pipe assemblies 5 and surge tank assembly 6 jointly form an intake manifold.

The surge tank 13 is defined by a top wall 13*a*, a pair of side walls 13*b* and 13*c*, a bottom wall 13*d*, and a pair of end walls so as to define a chamber therein, and is generally shaped like a box. The intake pipe extensions 12 are integrally formed with the bottom wall 13*d*. The top wall 13*a* is initially molded as a separate member, and is joined to the side walls 13*b* and 13*c* and end walls by ultrasonic welding. Each intake pipe extension 12 is provided with a vertical downstream end and a laterally outwardly directed upstream end, and is therefore provided with the shape of letter L as seen from the front end. The upstream ends of the intake pipe extensions 12 corresponding to each cylinder bank open out in the surge tank 13, and the open ends or upstream ends of the intake pipe extensions 12 for each cylinder bank are aligned along a longitudinal line extending in parallel with the crankshaft 1.

A part of the bottom wall 13*d* of the surge tank 13 located centrally between the two cylinder banks and adjacent to an axial end of the surge tank 13 is provided with an opening which is connected to a throttle body 14. Thus, the air drawn from the throttle body 14 is introduced into the surge tank 13, and distributed to the respective cylinders via the intake passages 10 defined by the intake pipe extensions 13 and intake pipe assemblies 5. The internal volume of the surge tank 13 provides a resonance supercharging effect. The combined length of the intake passage 10 defined in the intake pipe extension 12 and intake pipe assembly 5 for each cylinder provides an inertia supercharging effect.

The top wall 13*a* of the surge tank 13 consists of a substantially flat panel member having a relatively large surface area, and is slightly spaced from the outer circumferential surfaces of the intake pipe extensions 12. The top wall 13*a* is provided with a central opening 16 which is somewhat elongated in the longitudinal direction. This opening 16 is closed by a removeable lid 17 which is attached to the remaining part of the top wall 13*a* by threaded bolts 18. In this case, the peripheral part of the lid 17 is provided with through holes, and the part of the top wall 13*a* surrounding the central opening 16 is provided with corresponding threaded blind holes. Therefore, the threaded bolts 18 are passed through the mounting holes and threaded into the corresponding threaded holes. One of the annular mating surfaces of these two parts is provided with an annular groove receiving an O-ring 30 to ensure an air-tight closure of the central opening 16 by the lid 17.

Thus, as will be discussed in more detail hereinafter, the access to threaded bolts 15 for securing the surge tank assembly 6 to the intake pipe assemblies 5 can be gained from the central opening 16 formed in the top wall 13*a* of the surge tank 13 so that relatively short threaded bolts can be used, and the available space can be efficiently utilized for the effective volume of the surge tank 13. As shown in FIG. 1, the head of each threaded bolt 15 is offset from the periphery of the central opening by a distance C so as to permit the access to the head of the threaded bolt 15 by an appropriate tool.

The bottom wall 13*d* can be given with a relatively high rigidity in spite of a relatively large surface area thereof because the side and end walls and intake pipe extensions are integrally formed therewith. However, the top wall 13*a* may lack in rigidity because of a large surface area thereof. However, according to the illustrated embodiment, the peripheral part of the lid 17 has an increased thickness so as to ensure an adequate rigidity to the top wall 13*a* as well. The lid 17 may be additionally or alternatively made of a relatively rigid material or is otherwise given with an increased rigidity. The part of the top wall 13*a* surrounding the central opening 16 may also be provided with an increased thickness for an added rigidity of the top wall 13*a* of the surge tank 13. Thus, the surge tank 13 is provided with a high rigidity over an entire part thereof so that any undesirable vibrations of the surge tank 13 can be avoided.

A spacer 19 is interposed between the mating surfaces of the intake pipe assemblies 5 and the surge tank assembly 6. In this case, the spacer 19 is made of die cast aluminum alloy. A metal gasket 31 is interposed between the spacer 19 and the intake manifold assemblies 5.

The mating surface 20 of the surge tank assembly 6 abutting the spacer 19 is provided with six passage openings 21 communicating with the intake passages 10, and mounting holes 22 for passing the threaded bolts 15. Recesses 23 are formed in appropriate locations of the mating surface 20 of the surge tank assembly 6 to minimize the weight of the surge tank assembly 6 and ensure a favorable surface contact. The spacer 19 and metal gasket 31 are also provided with corresponding openings.

Figure 4:
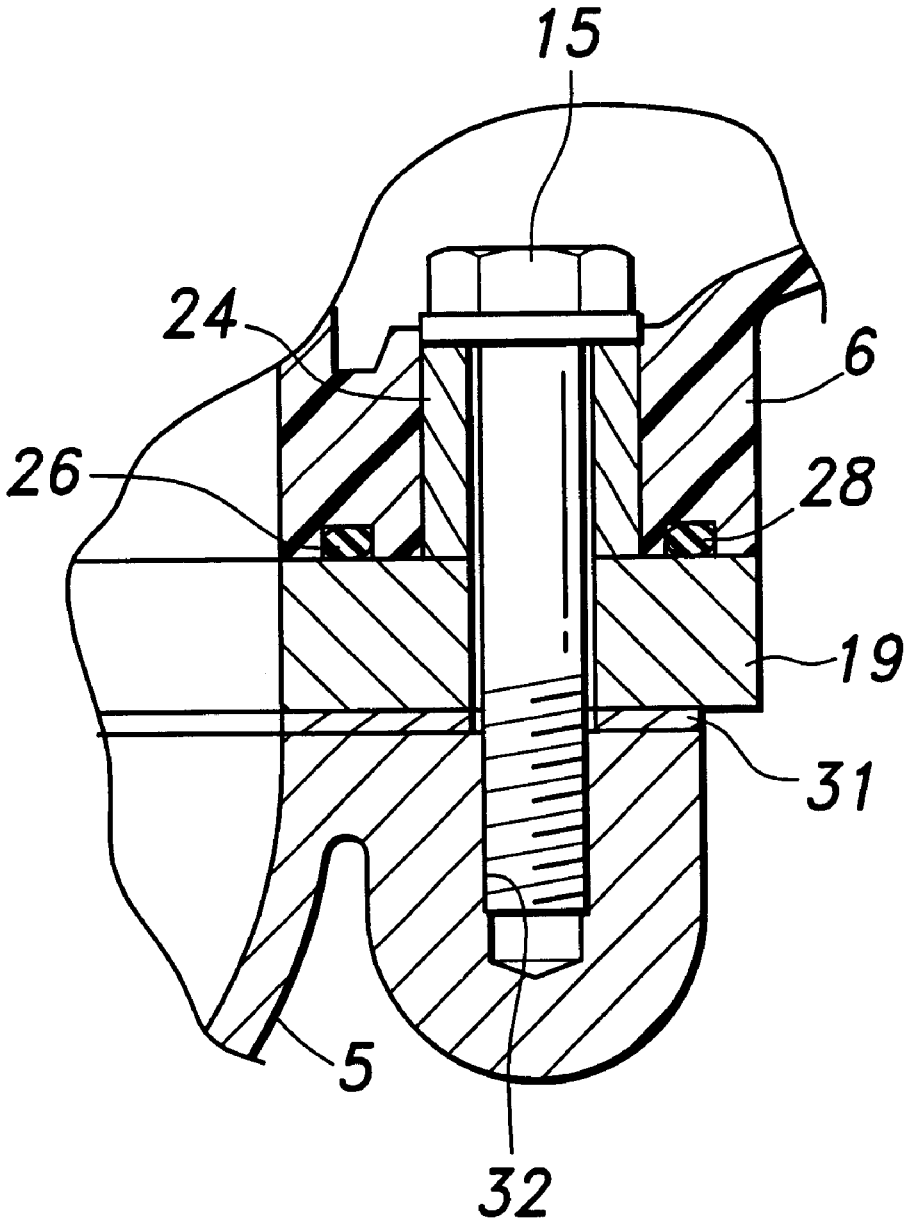
FIG. 4 is an enlarged sectional view of a part surrounding one of the threaded bolts passed through the bottom wall of the surge tank assembly and threaded into the end surface of the intake pipe assembly.

A metallic collar 24 is press fitted into each of the mounting holes 22 as best shown in FIG. 4 so that the part of the surge tank assembly 6 subjected to the axial forces of the threaded bolts 15 may be prevented from being deformed or otherwise damaged by the axial forces. The threaded bolts 15 are passed through the mounting holes formed in the bottom wall 13*d* of the surge tank 13 and spacer 19, and are threaded into threaded blind holes 32 formed in the opposing end surface of the corresponding intake pipe assembly 5 to securely attach the surge tank assembly 6 to the intake pipe assembly 5. In this embodiment, the intake pipe assemblies 5 are made of metallic material while the surge tank assembly 6 is made of plastic material. This provides a high level of mechanical stability while significantly reducing the overall weight. If designed the intake pipe assemblies 5 may also be made of plastic material. In either case, the two-piece or three piece arrangement of the intake manifold affords a favorable design while simplifying the assembly work.

The mating surface 20 is also provided with grooves 25 which individually surround each of the passage openings 21 and mounting holes 22. In this embodiment, the grooves 25 include the main parts surrounding individual passage openings 21, connecting parts 27 connecting the adjacent main parts and a peripheral part 28 extending along the outer periphery of the mating surface 20 and joined by the main parts surrounding the individual passage openings 21. Thus, each of the mounting holes 22 is wholly surrounded jointly by the peripheral groove 28, connecting parts 27 and main parts of the grooves surrounding the individual passage openings 21.

A seal member 26 having the same shape as the pattern of the grooves 25 is received in these grooves 25. When the seal member 26 is received in these grooves 25, a part of the seal member 26 projects out of the grooves 25. The seal member 26 is made of elastomeric material and is provided with a circular or elliptic cross section. Thus, the seal member 26 provides the sealing of the passage openings 21 and mounting holes 22 at the same time. When the threaded bolts 15 are fully threaded into threaded blind holes 31 formed in the end surface of the corresponding intake pipe assembly 5, the mating surface 20 of the surge tank assembly 6 comes into close contact with the opposing surface of the spacer 19, and the seal member 26 which is resiliently compressed inside the grooves 25 ensures a required sealing. The grooves 25 for receiving the seal member 26 was provided on the side of the mating surface 20 of the surge tank assembly 6 in the foregoing embodiment, but may also be provided in the opposing surface of the spacer 19 or in both the surfaces.

Although the present invention has been described in terms of a preferred embodiment thereof, it is obvious to a person skilled in the art that various alterations and modifications are possible without departing from the scope of the present invention which is set forth in the appended claims. For instance, the present invention is applicable not only to V-type engines but also to in-line cylinder engines. The applications of the engines embodying the present invention are not limited to outboard marine drives but also to automotive, general-purpose and other applications. The material for the various parts of the intake manifold can be selected at will without departing from the spirit of the present invention.

What is claimed is:

1. An intake manifold for an internal combustion engine, comprising:

an intake pipe assembly including at least one intake pipe defining an intake passage having a downstream end attached to an intake port of the engine and an upstream end defining an end surface, said end surface being provided with a plurality of threaded blind holes;

a surge tank assembly including a bottom wall, peripheral wall and upper wall jointly defining a chamber having a certain volume therein, said chamber including a downstream end abutting said end surface at said upstream end of said intake pipe and an upstream end connected to a throttle body for introducing intake air into said chamber in a controlled manner, said bottom wall being provided with a mating surface adapted to said end surface and mounting through holes corresponding to said threaded blind holes;

threaded bolts passed through said mounting through holes from inside said chamber and threaded into said threaded blind holes to securely connect said downstream end of said chamber with said upstream end of said intake pipe; and a seal member interposed between said end surface of said intake pipe and said mating surface of said surge tank assembly so as to seal off said intake passage and mounting holes individually.

2. An intake manifold for an internal combustion engine according to claim 1, wherein said seal member comprises an O-ring made of elastomeric material, and at least one of said mating surface and end surface is provided with a groove for receiving said seal member.

3. An intake manifold for an internal combustion engine according to claim 2, wherein said engine comprises a plurality of cylinders, and said seal member comprises a main part surrounding each intake passage, a connecting part connecting adjacent main parts, and a peripheral part extending along periphery of an interface between said end surface and mating surface and joining said main parts of said seal member, said threaded bolts being passed through between said main parts and peripheral part of said seal member.

4. An intake manifold for an internal combustion engine according to claim 1, further comprising a spacer member interposed between said mating surface and end surface, said spacer member being provided with through holes corresponding to said intake passage and mounting through holes.

5. An intake manifold for an internal combustion engine according to claim 4, wherein said seal member comprises an O-ring made of elastomeric material, and at least one of said mating surface, end surface, and two sides of said spacer member is provided with a groove for receiving said seal member.

6. An intake manifold for an internal combustion engine according to claim 1, wherein at least most part of said surge tank assembly is made of plastic material.

7. An intake manifold for an internal combustion engine according to claim 1, wherein at least most part of said intake pipe assembly is made of metallic member.

8. An intake manifold for an internal combustion engine according to claim 1, wherein said engine consists of a V-type cylinder, and said intake manifold is disposed between a pair of cylinder banks of said engine.

9. An intake manifold for an internal combustion engine according to claim 1, wherein said top wall of said surge tank assembly is provided with an opening for permitting access to a head of each of said threaded bolts, and a lid member for detachably closing said opening.

10. An intake manifold for an internal combustion engine according to claim 9, wherein said lid member is provided with a relatively high rigidity.

11. An intake manifold for an internal combustion engine according to claim 1, wherein at least bottom wall of said surge tank assembly is made of plastic material, and said mounting through hole is defined by a metallic collar securely fitted into said bottom wall.

12. An intake manifold for an internal combustion engine according to claim 1, wherein said surge tank assembly comprises an intake pipe extension formed in said downstream end of said chamber, said intake pipe extension being provided with a downstream end communicating with said upstream end of said intake pipe, and an upstream end opening out inside said chamber.

13. An intake manifold for an internal combustion engine according to claim 12, wherein said intake pipe and intake pipe extension jointly define a continuous intake passage having a prescribed length.

14. An intake manifold for an internal combustion engine according to claim 1, wherein said seal member comprises a gasket interposed between said end surface and mating surface.

15. An intake manifold for an internal combustion engine according to claim 14, further comprising a spacer member interposed between said mating surface and end surface, said spacer being provided with through holes corresponding to said intake passage and mounting through holes.

* * * * *